US005657965A

United States Patent [19]

Arias

[11] Patent Number: 5,657,965

[45] Date of Patent: Aug. 19, 1997

[54] STAPLE AND TACK REMOVER

[76] Inventor: Arturo G. Arias, 300 Bayview Dr. #2104, North Miami Beach, Fla. 33160

[21] Appl. No.: 512,964

[22] Filed: Aug. 9, 1995

[51] Int. Cl.[6] ..... B25C 11/00

[52] U.S. Cl. ..... 254/28

[58] Field of Search ..... 254/28, 18

[56] References Cited

U.S. PATENT DOCUMENTS

| | | | |
|---|---|---|---|
| 2,596,719 | 5/1952 | Pankonin | 254/28 |
| 3,311,346 | 3/1967 | Almond | 254/28 |
| 4,674,727 | 6/1987 | McAlister | 254/28 |
| 5,085,404 | 2/1992 | Thieleke et al. | 254/28 |
| 5,195,724 | 3/1993 | Koo | 254/28 |

FOREIGN PATENT DOCUMENTS

| | | | |
|---|---|---|---|
| 334373 | 9/1989 | European Pat. Off. | 254/28 |

*Primary Examiner*—Robert C. Watson
*Attorney, Agent, or Firm*—Robert M. Downey

[57] ABSTRACT

A device for removing staples and tacks includes an upper jaw and a lower jaw pivotally connected to one another, the upper jaw including spaced, parallel teeth disposed in opposing relation to spaced, parallel teeth on the lower jaw. A wedge member extends from the upper jaw, between the teeth thereof and terminates at an acute distal edge beyond pointed distal ends of the teeth. A flat outer surface of the wedge member is angled slightly outward relative to the upper teeth so that the distal edge is disposed at an optimum angle of attack to slide under the staple or tack when closing the jaws, and an inner bearing surface of the wedge member is structured and disposed for engaging and initiating prying of the staple or tack from the object as the upper and lower jaws are further closed toward a closed position, thereby enabling the teeth of the jaws to pass under and engage the staple or tack to complete removal thereof from the object.

1 Claim, 1 Drawing Sheet

STAPLE AND TACK REMOVER

BACKGROUND OF THE INVENTION

1. Field of the Invention

This invention relates generally to staple and tack removers, and more specifically, to a device which is adapted to remove staples which are tightly fitted into paper, walls, and other substrate, as well as being well suited for removing tacks which are embedded in bulletin boards, walls, and the like.

2. Description of the Related Art

Conventional designs for staple removers are well-known in the art. Generally, they employ a pair of opposing jaw members which have narrow, pointed teeth at their free ends. To remove a staple, the teeth are placed against the paper on opposite sides of the crown of the staple, and the jaws are closed together as pressure is applied against the paper so that the outer surfaces of the teeth slide along the surface as the pointed free ends are guided between the staple and the paper. The teeth increase in width from their pointed tips, and thus, as the jaws are closed together and the teeth are forced farther under the staple crown, the opposing teeth combine to pry the staple away from the paper.

When a staple is deeply embedded in an object, or when it is clamped into a large stack of papers, the crown is tight against the surface of the object or paper. In this case, it is very difficult to force the teeth of the staple remover under the crown of the staple, and often this cannot be accomplished without scratching or tearing the object or paper as the teeth are forced against the surface.

The removal of thumb tacks from bulletin boards, walls, and the like can also be a frustrating task. Unfortunately, the narrow, opposed teeth of staple removers do not lend themselves well to the task of prying under a rounded tack head. The teeth tend to slip to one side of the tack head instead of sliding squarely under it, resulting in either missed pulls or bent tacks. Further, the jaws of most staple removers do not open far enough to grasp under the tack head.

Many modifications have been made to the conventional design of the staple remover in order to adapt it to certain applications. One such modification can be found in U.S. Pat. No. 5,085,404. The device in this patent employs a pair of opposing anvil members disposed between the teeth of the jaws. When the jaws are closed, the anvil members move into abutting engagement to grasp the staple therebetween. The modification is designed to provide a better grip on the crown of the staple to be removed, but does not address the problems discussed above which are inherent in the conventional design. This is because the anvil members in the device disclosed in U.S. Pat. No. 5,085,404 trail the ripe of the teeth when the jaws are closed on a staple embedded in an object. The initial engagement of the pointed teeth between the staple and paper is exactly the same as with the conventional design, and the anvil members do not grasp the staple crown until after the teeth have partially pried the staple from the paper, if in fact prying was successful.

As with the device in U.S. Pat. No. 5,085,404, no design modification in the related art satisfactorily addresses the problems described above. Thus, there is a need for a staple remover which can more easily pry under a tightly embedded staple without much effort or force needed so that the surface of the object from which the staple is being removed is not damaged. In addition, there is a need for a staple remover which is structured for removing tightly embedded tacks from bulletin boards, walls, and the like.

SUMMARY OF THE INVENTION

The present invention fulfills the need in the art. Broadly described, the present invention provides a staple and tack remover which employs a centrally disposed wedge member to aid in removing staples which are tightly imbedded into paper or another object. The device of the present invention is also useful for removing tracks from bulletin boards, walls and the like.

In a preferred embodiment of the present invention, the device provides an upper jaw and a lower jaw pivotally connected to one another, and including parallel left and right upper teeth extending from the upper jaw, and parallel left and right lower teeth extending from the lower jaw, opposing the upper teeth. The upper and lower teeth all terminate at pointed distal ends.

A wedge extends from the upper jaw in spaced relation between and substantially parallel to the upper teeth, terminating at a free, sharp distal edge beyond the pointed distal ends of the upper teeth. When the upper and lower jaws are closed toward one another, the wedge is received in a gap between the lower teeth, and the lower teeth are received in spaces between the upper teeth and the intermediate wedge.

Outer bearing surfaces disposed on each of the teeth engage and slide along the object in which the staple or tack is disposed. Inner bearing surfaces on each of the teeth and on the wedge engage and pry the staple or tack from the object. The outer and inner bearing surfaces of each of the teeth converge to form the pointed distal tips and diverge as they move away from the tips. The outer and inner bearing surface of the wedge converge to form the acute free distal edge and diverge as they move away from the edge.

It is preferred that the outer bearing surfaces of the teeth be substantially narrower than the outer surface of the wedge. The distal edge of the wedge should be substantially parallel to and below an imaginary line connecting the pointed tips of the upper teeth. The outer surface of the wedge is flat and angled slightly outward relative to the upper teeth so that the distal edge is below and outward relative to the pointed tips of the upper teeth.

An alternate form of the present invention provides an elongated upper jaw having a pivot end and a free end, and an elongated lower jaw having a pivot end and a free end. The upper and lower jaws are pivotally connected to one another at their respective pivot ends. Substantially parallel left and right upper teeth extend from the free end of the upper jaw, and substantially parallel left and right lower teeth extend from the free end of the lower jaw in opposing relation to the upper teeth. Each of the teeth converges to a pointed distal tip. A wedge extends from the free end of the upper jaw in spaced relation between the Upper teeth. Outer and inner surfaces of the wedge converge to a sharp distal edge disposed beyond and outward of the upper teeth. When the jaws are moved toward one another, the distal edge of the wedge passes between the pointed tips of the lower teeth and within a gap between the lower teeth, and the lower teeth are received on opposite sides of the wedge in spaces between the upper teeth and the wedge.

Accordingly, it is an object of the present invention to provide a staple and tack remover which is uniquely adapted to remove staples which are tightly imbedded into paper or another object.

It is a further object of the invention to provide a staple and tack remover which is well suited for removing tacks from bulletin boards, walls and the like.

It is a further object of the invention to provide a staple and tack remover which employs a wedge member disposed between the teeth of the remover to initially engage the staple or tack to be removed.

These and other objects, features, and advantages of the present invention may be more clearly understood and appreciated from a review of the following detailed description of the disclosed embodiment and by reference to the appended drawings and claims.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
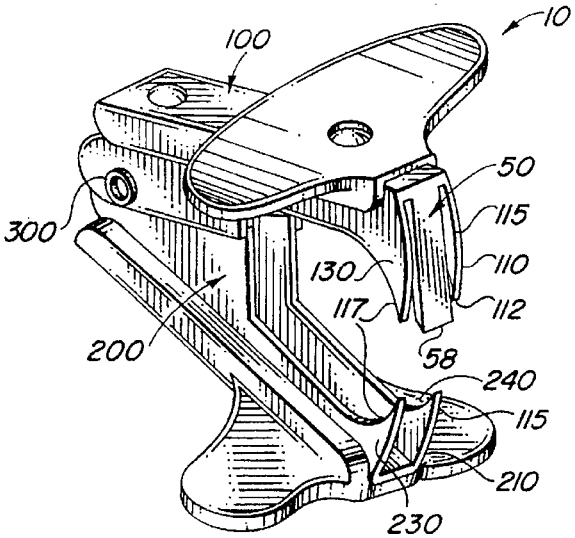
FIG. 1 is front perspective view of the staple and tack remover of the present invention.

Referring now to the drawings, in which like numerals indicate like elements throughout the several views, it is noted that the present invention may be rotated about any axis in physical space, and the particular elements will maintain their relative relationship to one another. The terms "upper" and "lower" are used in this specification and in the appended claims to facilitate clear description of the present invention. In no way do these terms limit the invention to any particular positioning or attitude in physical space.

FIG. 1 illustrates generally at 10 the preferred embodiment of the present invention. The invention in part employs the conventional design for staple removers which is well-known in the art. As with a conventional design, the invention 10 includes an upper jaw 100 and a lower jaw 200, pivotally connected at 300 and opposing one another. The upper jaw 100 contains spaced, parallel left and right upper teeth 110, 130. Similarly, the lower jaw 200 contains left and right lower teeth 210, 230 separated by gap 240, and in opposing relation to the upper teeth 110, 130. The upper teeth 110, 130 are spaced further from one another than are the lower teeth 210, 230 such that as the jaws 100, 200 are closed together (as will be illustrated in the discussion of FIG. 3 below), the lower teeth 210, 230 fit between upper teeth 110, 130.

Each of the teeth 110, 130, 210, 230 has a narrow, elongated outer bearing surface 115 of substantially constant width. Each of the teeth 110, 130, 210, 230 also has a similarly narrow, elongated inner bearing surface 117. The teeth 110, 130, 210, 230 are tapered such that the inner and outer bearing surfaces of each tooth converges to a pointed distal tip 112. The outer bearing surfaces 115 of the upper teeth 110, 130 are slightly curved to approximate circumferencial segments on the same substantially cylindrical arc centered near pivot axis 300 at the center of the pivotal connection of the upper and lower jaws 100, 200. The outer bearing surfaces 115 of the lower teeth 210, 230 are also slightly curved to approximate circumferencial segments on a substantially cylindrical arc also centered near pivot axis 300. Because their respective centers are not necessarily located exactly at pivot axis 300, these imaginary cylinders are not necessarily congruent.

Not shown in the drawings are the mechanisms for preventing the jaws 100, 200 from exceeding a certain degree of separation and for biasing the jaws 100, 200 in this relaxed position of maximal separation. This keeps the remover 10 biased in its open position, ready for use. These functions can be accomplished by any of a number of means well-known in the art. The preferred mechanisms are a torsion spring around pivot 300 and contact points on the jaws 100, 200.

Figure 2:
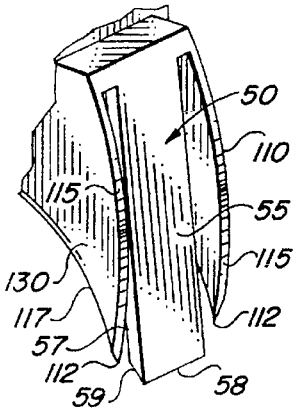
FIG. 2 is an isolated view, shown in perspective, of left and right upper teeth and a wedge of the upper jaw of the staple and tack remover.

A wedge 50 is disposed on the upper jaw 100, in spaced relation between the left and right upper teeth 110, 130, defining spaces 52, 54 on opposite sides of the wedge 50. The wedge 50, and its relation to the upper teeth 110, 130 can be more clearly seen with reference to FIG. 2, which shows a detailed view of this portion of the invention 10. Wedge 50 has an elongated flat outer surface 55 having a width which is preferably greater than that of the outer bearing surfaces 115 of the teeth 110, 130, 210, 230. Wedge 50 also has an inner bearing surface 57 including an angled lower zone 59. The wedge 50 is tapered such that the lower zone 59 of the inner surface 57 and the outer surface 55 converge at an acute distal edge 58.

The wedge 50 extends farther from upper jaw 100 than do the upper teeth 110, 130, so that the distal edge 58 is disposed below the pointed tips 112. Also, the flat outer surface 55 is angled slightly outward relative to the upper teeth so that the distal edge 58 is outward of the tips 112 of the upper teeth, providing an optimum angle of attack to guide the distal edge between the staple crown or tack and the surface of the object to which the staple or tack is attached. As the jaws of the staple remover 10 are closed on a staple, the edge 58 of wedge 50 leads the tips 112 of upper teeth 110, 130. Preferably, the edge 58 of wedge 50 aligns in coplanar relation with the tips of the lower teeth 210, 230 moving along the arc defined by the outer bearing surfaces of the lower teeth as the jaws 100, 200 are moved closed and the wedge begins to pass between the lower teeth 210, 230. This allows the edge 58 of the wedge 50 to retain close contact with the surface of the object as the jaws 100, 200 of the staple remover 10 are closed on the staple, while preventing the edge 58 from scratching or damaging the surface. Thus, the distal edge 58 of the wedge 50 will initially engage under the staple, prior to the teeth on the upper and lower jaws. This is unlike a conventional staple remover in which the upper and lower teeth are intended to initially engage under the staple. Because of its shape, central position and angled relation to the teeth, the broad, narrowly tapered wedge 50, having the acute distal edge 58, more easily slips between the staple and the material in which it is embedded than do the upper teeth 110, 130 and lower teeth 210, 230. In this manner, the wedge 50 initiates prying and separation of the staple from the surface of the paper or object. As the jaws 100, 200 are closed more tightly, the staple will slide along the lower zone 59 of the inner bearing surface 57 of the wedge, pulling and separating the staple from the object, and allowing the upper teeth 110, 130 and lower teeth 210, 230 to pass easily between the staple and the surface of the object. From here, the jaws 100, 200 are further closed and the staple is pulled as with a conventional staple remover.

Because of its broad distal edge 58 and central location, the wedge 50 is also very well suited for removing tightly imbedded tacks. The pointed tips 112 of the lower teeth 210, 230 slide under and cooperate to hold the tack head and prevent lateral slipping. This allows the wedge 50 to slide under the tack head and pry it from the material. Because the wedge 50 is centered and combines with the lower teeth 210, 230 to create a triangular contact with the tack head, there is no tendency for lateral slippage. Further, unlike the conventional design, the jaws 100 and 200 are biased to a normally open position which is sufficient to receive the tack head between the tips 112 of the upper and lower teeth.

Figure 3:
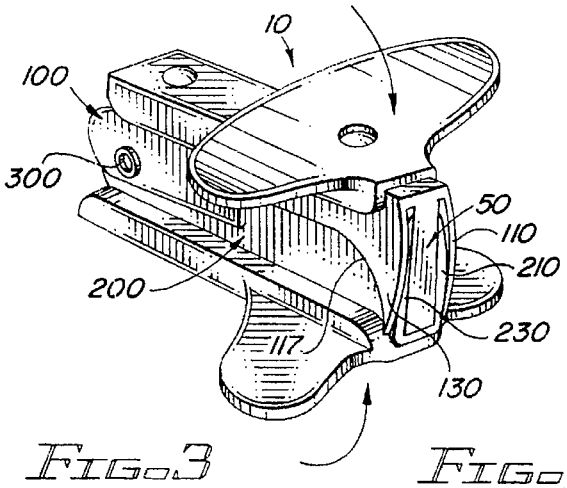
FIG. 3 is a front perspective view of the staple and tack remover with the upper and lower jaws shown in a closed position.
Figure 4:
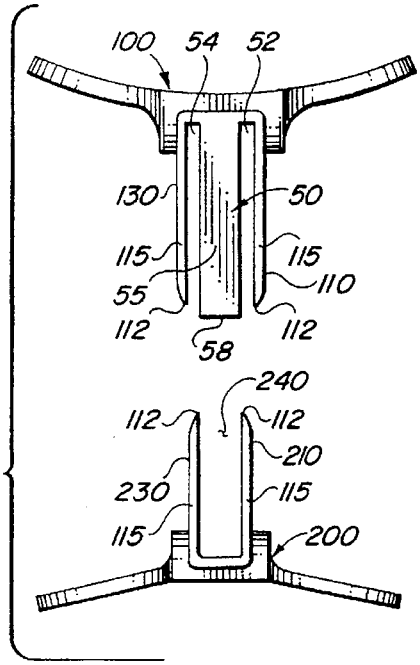
FIG. 4 is a front plan view of the free end zones of the upper and lower jaw showing the upper teeth and wedge in opposing relation to the lower teeth.
Figure 5:
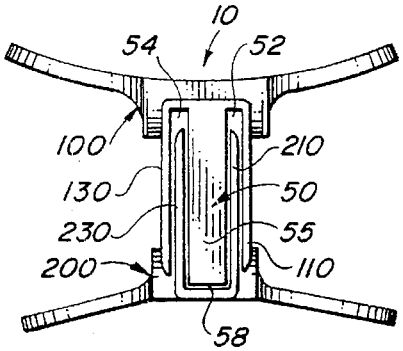
FIG. 5 is a front plan view of the upper and lower jaws shown in a closed position.
Figure 6:
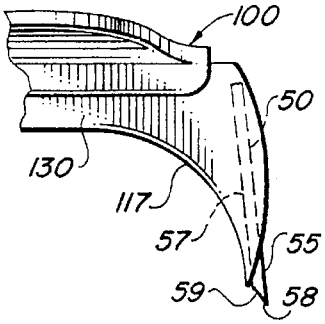
FIG. 6 is an isolated side plan view of the wedge and upper teeth.

Turning to FIG. 3, the staple and tack remover 10 can be seen in its closed position. Wedge 50 fits into the gap 220 between the left and right lower teeth 210, 230. Lower teeth 210, 230 fit into the spaces 52, 54 between the wedge 50 and the upper teeth 110, 130. It is preferred that the outer bearing surfaces 115 of the lower teeth be shaped such that as the jaws 100, 200 are closed, the lower edge 58 of the wedge remains flush with and travels along the arc defined by the outer bearing surfaces throughout the range of motion in which the wedge passes within the gap 240.

While the present invention has been described in what is considered to be a preferred and practical embodiment, it is recognized that departures may be made within the spirit and scope of the invention which is not to be limited except as set forth in the following claims and within the Doctrine of Equivalents.

Now that the invention has been described,

What is claimed is:

1. An apparatus for removing a staple or tack from an object comprising:

an upper jaw having a pivot end zone and a free end zone, a lower jaw having a pivot end zone and a free end zone, said upper and lower jaws being pivotally connected to one another at said respective pivot end zones, a pair of spaced, parallel left and right upper teeth extending from said free end zone of said upper jaw, said upper teeth each converging to a pointed distal tip, a pair of spaced, parallel left and right lower teeth extending from said free end zone of said lower jaw in opposing relation to said upper teeth and defining a gap between said left and right lower teeth, said lower teeth each converging to a pointed distal tip, a wedge extending from said free end zone of said upper jaw in spaced relation between said left and right upper teeth to define a first space between said left upper tooth and said wedge and a second space between said right upper tooth and said wedge, and said wedge terminating at a free distal edge beyond said pointed distal tips of said left and right upper teeth, said wedge further including an outer flat surface and an inner bearing surface, said outer flat surface and said inner bearing surface extending from said free end zone of said upper law and converging towards said free distal edge, said outer surface of said wedge being angled outward relative to said upper teeth to position said free distal edge of said wedge outward of said upper teeth at an optimal angle for engaging under the staple or tack and initiating prying of the staple or tack from the object, said upper and lower teeth further including outer and inner bearing surfaces, said outer and inner bearing surfaces of said teeth being substantially narrower than said outer flat surface of said inner bearing surface of said wedge, and wherein said upper and lower jaws are movable toward one another so that said wedge is received in said gap between said left and right lower teeth and said left and right lower teeth are received in said first and second spaces respectively, so that said free distal edge travels along an arc defined by said outer bearing surfaces of said lower teeth in flush relation therewith.

* * * * *